US006105720A

United States Patent [19]

Kumher et al.

[11] Patent Number: 6,105,720

[45] Date of Patent: Aug. 22, 2000

[54] MULTI-POSITION LADDER AND SUPPORT THEREFOR

[76] Inventors: Don A. Kumher, 13370 Fisher Rd., Burton, Ohio 44021; Boyd S. Kumher, 925 E. Archwood Ave., Akron, Ohio 44306

[21] Appl. No.: 09/322,592

[22] Filed: May 28, 1999

Related U.S. Application Data

[63] Continuation-in-part of application No. 09/186,863, Nov. 5, 1998.

[51] Int. Cl.[7] ..... E06C 5/00; E04G 3/14

[52] U.S. Cl. ..... 182/127; 182/39

[58] Field of Search ..... 182/127, 36, 39, 182/206, 107, 214

[56] References Cited

U.S. PATENT DOCUMENTS

| | | |
|---|---|---|
| 888,383 | 5/1908 | Asch . |
| 2,840,290 | 6/1958 | Roberts . |
| 3,434,566 | 3/1969 | Miller . |
| 4,482,029 | 11/1984 | Prochaska . |
| 4,660,677 | 4/1987 | Hunter . |
| 4,846,303 | 7/1989 | Cooper et al. . |
| 5,366,052 | 11/1994 | Keh-Lin . |
| 5,653,307 | 8/1997 | Kerr . |

FOREIGN PATENT DOCUMENTS 53-38016 4/1978 Japan .

*Primary Examiner*—Daniel P. Stodola
*Assistant Examiner*—Hugh B. Thompson
*Attorney, Agent, or Firm*—Amin, Eschweiler & Turocy, LLP

[57] ABSTRACT

A multi-position ladder includes a ladder, a longitudinally extending support member for supporting the ladder, and a connecting member connecting the support member and the ladder. The connecting member includes a sliding bar, a pivot bar, and a rotating arm, the sliding bar being in sliding engagement with the support member for permitting lateral shifting movement of the ladder along the support member to one of multiple generally vertical use positions, the pivot bar extending laterally outwardly from the sliding bar for permitting pivotable movement of the ladder about the pivot bar between a generally vertical use position and one of multiple storage positions, and the rotating arm providing tilting movement of the ladder towards or away from a wall to which the support member is attached. The ends of the rotating arm are slidably received in elongated slots in the uprights of the ladder for permitting sliding movement of the ladder relative to the rotating arm. A locking assembly permits selective securing of the free end of the ladder to the support member in a storage position.

18 Claims, 7 Drawing Sheets

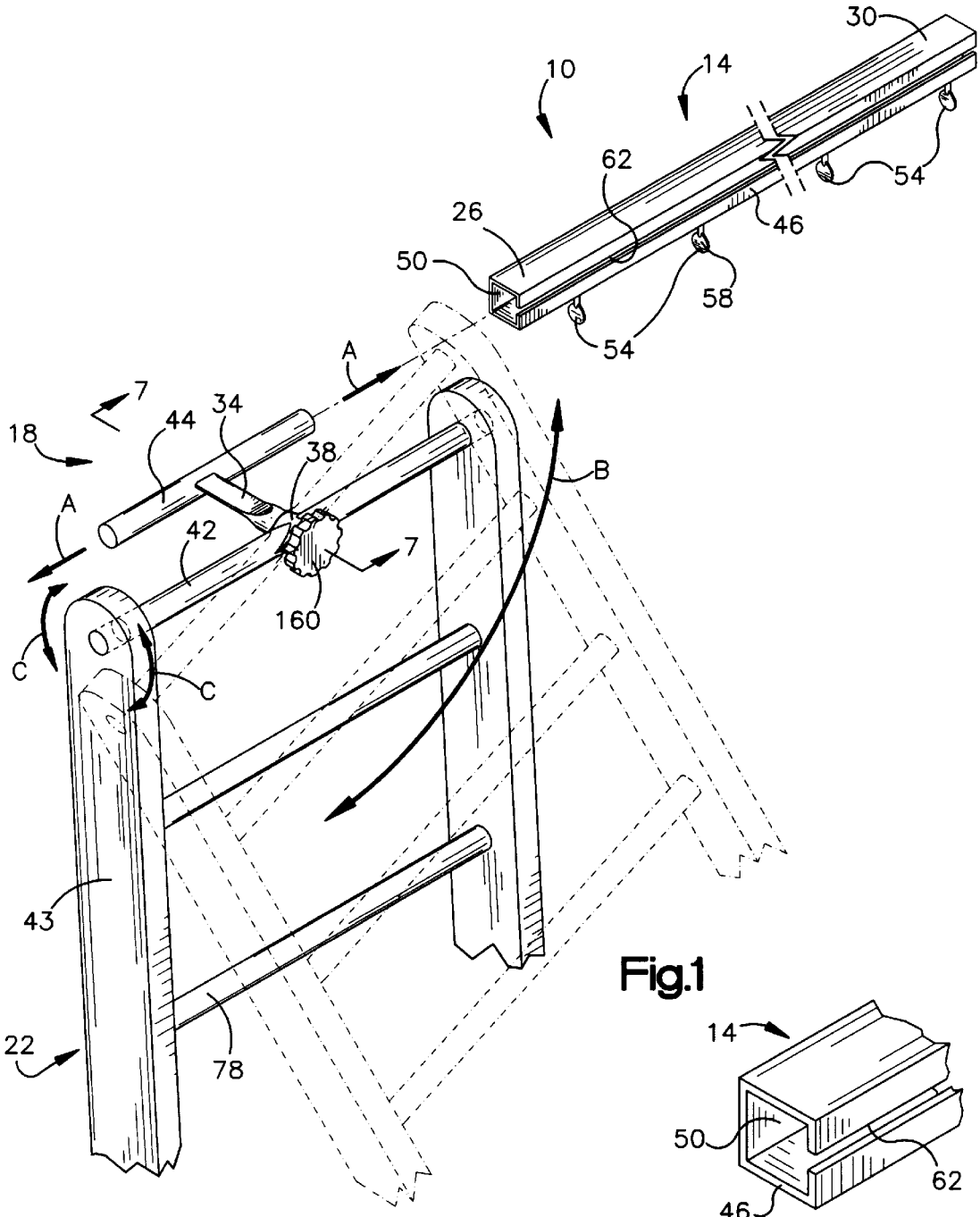
Fig.1
Fig.3
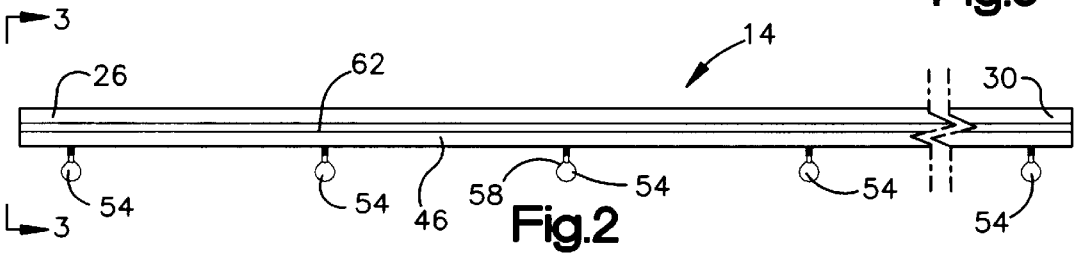
Fig.2

MULTI-POSITION LADDER AND SUPPORT THEREFOR

RELATED APPLICATION DATA

This application is a continuation-in-part of U.S. patent application Ser. No. 09/186,863 filed Nov. 5, 1998.

FIELD OF THE INVENTION

The present invention relates to a multi-position ladder and a support therefor and, more particularly, a ladder that is laterally slidable between multiple generally vertical use positions and pivotable to multiple storage positions along the support.

BACKGROUND OF THE INVENTION

Prior art ladders used in industry and construction are often specifically designed to gain quick access to materials on the roof of a vehicle or on a shelf in a warehouse. In the case of a vehicle, for example, a construction van or truck, the ladder is typically vertically mounted relatively parallel to the side or rear of the vehicle in a single fixedly attached position. In this regard, a worker must maneuver the vehicle prior to loading or unloading materials to orientate the ladder to an accessible position relative to the desired material's site. This, oftentimes, is inconvenient, for example, in tight work zones or storage places.

In the case of a warehouse, typically the ladder must be removed from a storage site, carried to the desired material's location, raised to the desired height for loading or unloading of materials, lowered and then returned to the storage site. This can be burdensome and inconvenient, especially in crowded work zones or if frequent loading and unloading is required.

What is needed is a ladder that may be conveniently moved to an out-of-the-way yet accessible position, conveniently positioned for access to the roof of a vehicle or a shelf of a warehouse, and also readily and conveniently returned to its storage position.

SUMMARY OF THE INVENTION

The present invention provides a multi-position ladder assembly comprising a ladder and a support for supporting the ladder wherein the assembly permits the ladder to be shifted laterally across the support, pivotably moved in a lateral direction, tilted towards and away from the support, slidably moved along at least a portion of the length of the ladder, and selectively secured to the support.

According to one aspect of the invention, the multi-position ladder assembly includes a ladder, a longitudinally extending support member for supporting the ladder, and a connecting member connecting the support member and the ladder. The multi-position ladder assembly provides for three types of movement of the ladder. The ladder may be laterally shifted from side-to-side across the support member, pivotably moved from side-to-side to a storage position, and/or tilted away from or towards a wall or frame to which the support member is connected. The movements may be made either simultaneously or independently depending on the limitations or needs of a particular loading/unloading site.

According to a preferred embodiment of the invention, the support member comprises a C-shaped guide channel and the connecting member includes a sliding bar that slidably engages the guide channel for permitting lateral positioning of the ladder along the support member to one of multiple generally vertical use positions. The ends of the support member are preferably open permitting the ladder to be laterally removed from either of the ends.

According to a preferred embodiment of the invention, the connecting member includes a pivot arm preferably fixedly attached to and extending laterally outwardly from the sliding bar and a rotating arm preferably rotatably mounted relatively transverse to the pivot arm. The ladder is rotatably connected to the rotating arm for permitting pivotable movement of the ladder about the pivot arm between a generally vertical use position and one of multiple storage positions.

According to a preferred embodiment of the invention, the guide channel includes an elongated groove therein for slidably receiving the sliding bar. The sliding bar slidably engages the groove during lateral positioning of the ladder. The guide channel also defines an elongated slot substantially aligned with the elongated groove and a guide pin is fixedly attached to and extends laterally outwardly from the sliding bar. The guide pin slidably engages the elongated slot thereby guiding the connecting member and, consequently, the ladder during lateral positioning thereof.

According to a preferred embodiment of the invention, the ladder includes a pair of spaced upright members and a plurality of spaced parallel rungs extending between the upright members. The rotating arm is pivotably mounted at its ends within recesses disposed in the upright members and is substantially parallel to the rungs.

According to another aspect of the invention, the multi-position ladder includes a ladder, a support member for supporting said ladder, the support member being mounted to a wall, vehicle or other surface, a connecting member connecting the support member and the ladder, the connecting member supporting the ladder for sliding movement of the ladder relative to the connecting member along at least a portion of the length of the ladder.

According to a preferred embodiment of the invention, the connecting member also supports the ladder for tilting movement of the ladder towards and away from the wall, vehicle or other surface.

According to a preferred embodiment of the invention, the ladder includes uprights having elongated grooves disposed along at least a portion of the length of the ladder for slidably receiving therein the connecting member for guiding the ladder during sliding movement thereof. As preferred, the connecting member includes an adjustment mechanism including respective inserts that are slidably received within the elongated grooves. The ladder uprights cooperatively engage the inserts to provide substantially uniform movement of the ladder relative to the connecting member. Preferably, the inserts are made of nylon and the elongated grooves are lubricated to facilitate sliding contact between the inserts and the grooves. The attachment mechanism may include, as preferred, at least one tightening knob that, when tightened, substantially inhibits tilting movement and sliding movement of the ladder relative to the wall, vehicle or other surface and, when loosened, permits said tilting and sliding movement.

According to a preferred embodiment of the invention, the ladder includes an upright having one or more elongated slots disposed therein along at least a portion of the length of the ladder and the connecting member includes a rotating arm extending transverse to the length of the ladder, at least one of the ends of the rotating arm being in sliding engagement with the one or more slots during sliding movement of the ladder. The slots preferably form segments for providing incremental sliding movement of the ladder in a generally vertical use position. Still more preferably, the rotating arm is pivotably mounted at its ends within the slots for permitting tilting movement of the ladder towards and away from the wall, vehicle or other surface. At least one end of the rotating arm preferably includes one or more tightening knobs for selectively securing the end to the ladder thereby to substantially inhibit tilting movement and sliding movement of the ladder relative to the rotating arm.

According to a preferred embodiment of the invention, the support member is longitudinally extending and the connecting member is adapted to permit lateral shifting movement and positioning of the ladder to one of multiple generally vertical use positions along the extent of said support member. When the ladder is in a generally vertical use position the connecting member allows the ladder to be selectively adjusted in a generally vertical direction. Even more preferably, the ladder includes an upright having one or more elongated slots disposed therein along at least a portion of the length of the ladder and the connecting member includes a rotating arm extending transverse to the length of the ladder, the ends of the rotating arm being in sliding engagement with the one or more slots during sliding movement of the ladder. The slots preferably include segments for providing incremental sliding movement of the ladder in a generally vertical direction.

According to a preferred embodiment of the invention, the tilting movement defines a plane substantially perpendicular to a plane defined by said lateral shifting movement. Preferably, the connecting member supports the ladder for pivotal movement about a point where the ladder couples to the support member via the connecting member in an arc from side-to-side between a generally vertical use position and a storage position.

According to another aspect of the invention, the multi-position ladder assembly includes a ladder, a support member for supporting the ladder, the support member being mounted to a wall, vehicle or other surface, a connecting member connecting the support member and the ladder, and a locking assembly. The connecting member supports the ladder for at least three types of movement. The ladder may be pivotably moved about a point where the ladder couples to the support member via the connecting member in an arc from side-to-side between a generally vertical use position and a storage position. The ladder may be slidably moved relative to the connecting member along at least a portion of the length of the ladder. The locking assembly provides selective securing of the free end of the ladder to the support member when the ladder is pivoted to a storage position.

According to a preferred embodiment of the invention, the connecting member also supports the ladder for tilting movement of the ladder towards and away from the wall, vehicle or other surface.

According to another preferred embodiment of the invention, the locking assembly includes an engaging member connected to the ladder and adapted to slidably engage the support member to prevent movement of the ladder outwardly from the wall, vehicle or other surface. As preferred, the support member is a guide track and the engaging member includes an insert adapted to slidably engage the guide track. Preferably, the guide track is a C-shape channel and the insert is generally T-shape and fits at least partially within the C-shape channel. The insert is preferably made of nylon.

According to a preferred embodiment of the invention, the locking mechanism is biased to its engaged position. Preferably, the support member includes a locator hole and the locking mechanism includes a locking pin that is biased to slidably engage the support member through the locator hole to prevent lateral movement of the ladder along the support member.

According to a preferred embodiment of the invention, the locking assembly further includes a locking mechanism connected to the ladder, the locking mechanism being selectively moveable between an engaged position to prevent lateral movement of the ladder along the support member and a disengaged position to permit said lateral movement. Preferably, the locking mechanism includes at least one mount spaced apart from and aligned with the engaging member, the mount including a hole therethrough for receipt therein of the locking pin so that, when the locking pin engages the support member through the locator hole, the locking pin engages the engaging member thereby to provide a firm connection between the engaging member and support member.

According to yet another aspect of the invention, the multi-position ladder assembly includes, in combination with a wall, vehicle or other surface, a ladder including a pair of uprights having respective guide tracks and elongated slots disposed therein along the length of the ladder, a longitudinally extending support member for supporting the ladder, the support member being mounted to the wall, vehicle or other surface, and a connecting member connecting the support member and the ladder. The connecting member includes respective inserts that are slidably received within the guide tracks, the ladder uprights cooperatively engaging the inserts to provide substantially uniform movement of the ladder relative to the connecting member, and a rotating arm extending transverse to the length of the ladder, the ends of the rotating arm being slidably received in the elongated slots for permitting tilting movement of the ladder towards or away from the wall, vehicle or other surface, and sliding movement of the ladder along the ends of the rotating arm in a generally vertical direction.

Although the invention is shown and described with respect to one or more preferred embodiments, it is to be understood that equivalents and modifications will occur to others skilled in the art upon the reading and understanding of the specification. The present invention includes all such equivalents and modifications, and is limited only by the scope of the claims.

BRIEF DESCRIPTION OF THE DRAWINGS

FIG. 1 is a perspective view of a multi-position ladder constructed in accordance with the present invention;

FIG. 2 is a front elevation view of the support member of the multi-position ladder of FIG. 1;

FIG. 3 is a perspective view of an end of the support member of the multi-position ladder of FIG. 1 shown from the plane 3—3 in FIG. 2;

DETAILED DESCRIPTION OF PREFERRED EMBODIMENTS

Figure 4:
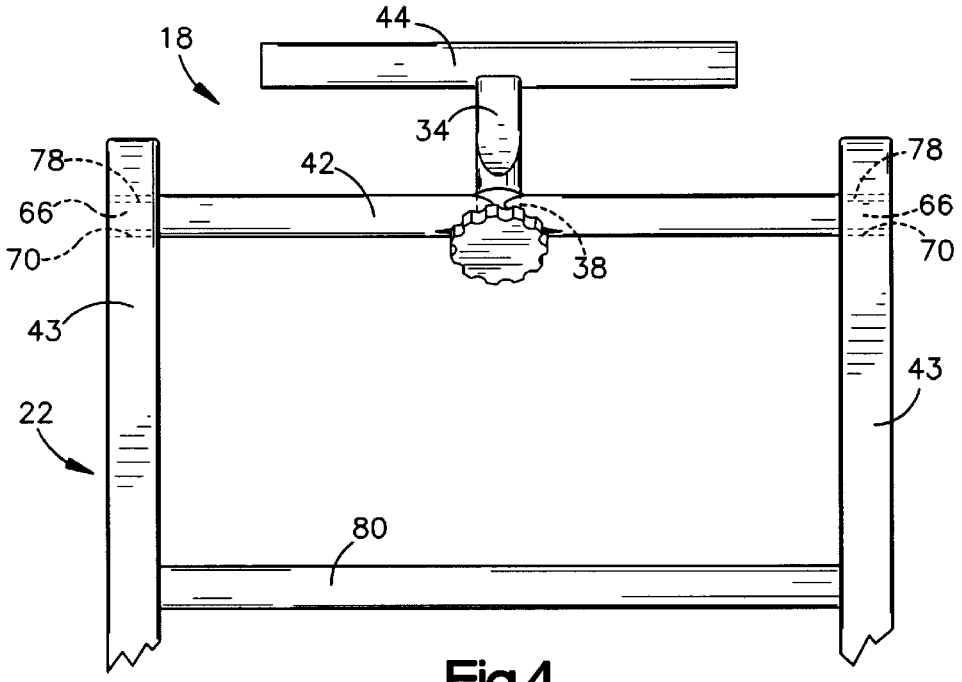
FIG. 4 is a front elevation view of the connecting member of the multi-position ladder of FIG. 1 shown with the sliding bar and pivot arm rotated slightly out of position relative to the rotating arm for clarity purposes.

Referring now to the Figures, there is seen in FIG. 1 a multi-position ladder constructed in accordance with the present invention generally indicated at reference numeral 10. The multi-position ladder 10 includes a longitudinally extending support member 14 preferably fixedly mounted (not shown), for example, to the side or rear of a vehicle or to the frame of a warehouse shelf. A connecting member 18 is mounted to the support member 14 and is adapted to carry laterally therealong a ladder 22 from one end or side 26 of the support member 14 to the other end or side 30 of the support member 14; the arrows A—A in FIG. 1 being representative of the lateral motion of the ladder 22.

The connecting member 18 includes an outwardly extending pivot arm 34. The ladder 22 is pivotably mounted to the pivot arm 34 via a bushing 38 or other suitable pivotable connection for permitting the ladder 22 to be pivoted, or swung, from side-to-side. This pivoting motion may be, for example, as shown in FIG. 1, in the same plane as the plane of lateral shifting motion; the arc B—B in FIG. 1 being representative of such pivoting motion of the ladder 22. As will be described below, the plane of pivoting motion varies with respect to the tilt position of the ladder 22. A rotating arm 42 is preferably rotatably mounted to the pivot arm 34 and preferably pivotably mounted to ladder uprights 43 of the ladder 22 for permitting the ladder 22 to tilt away from or towards a wall to which the support member 14 is attached. As shown in FIG. 1, the tilting is in a plane perpendicular to the aforedescribed lateral shifting motion and pivoting motion of the ladder 22; the arc C—C in FIG. 1 being representative of such tilting motion of the ladder 22.

In view of the foregoing, it will be appreciated that the ladder 22 may be moved from side-to-side along the support member 14 to any of a wide range of generally vertical use positions, thus permitting a worker to move the ladder 22 to a position, for example, having the most direct or convenient access to materials on the roof of a vehicle or on the shelf of a warehouse. After use, the ladder 22 can then be pivoted, or swung, about the pivot arm 34 along the arc B—B and raised to a suitable storage position sufficiently high to clear the ground or warehouse floor, or to an otherwise "out-of-the-way" position. The ladder 22 may also be tilted outwardly away from the wall of the vehicle or shelf of a warehouse so that it is raised up from the ground (or floor) to facilitate easier lateral shifting motion or pivoting motion. These and other advantages, as well as the structure, function and features of the multi-position ladder 10, are described in greater detail below.

The mounting arrangement between the connecting member 18 and support member 14 is described herein with respect to a sliding bar 44 in slidable engagement with a generally C-shaped guide channel 46. The C-shaped guide channel 46 preferably has a lubricant, for example, silicone grease within its groove or a polytetrafluoroethylene coating on its interior walls, for facilitating sliding contact between the surface of the sliding bar 44 and the interior walls. The guide channel 46 includes a groove 50 adapted to slidably receive and provide stabile interface contact with the sliding bar 44. The guide channel 46 and sliding bar 44 cooperatively engage to support the weight of the ladder 22 and/or a worker and load thereon. Of course, a round shaped guide channel may be used as an alternative, in which case the sliding bar 44 may include a bushing or other lubricating sleeve for promoting slidability between the round shaped guide channel and the sliding bar 44.

It will be appreciated that the aforedescribed components may be reversed to accomplish substantially the same result; that is, the support member 14 may include a sliding bar 44 and the connecting member 18 may include a C-shaped guide channel 46 that rides laterally along the sliding bar 44. In another alternative embodiment, the support member 14 may include a track or rail and the connecting member 18 may include guide pins or rollers that slidably engage the track or rail during lateral movement of the ladder 22. In this regard, it will be appreciated that alternative parts and/or arrangements may be used to accomplish the same effect of guided lateral shifting movement of the connecting member 18 relative to the support member 14 and such alternatives are contemplated as falling within the scope of the present invention.

The C-shaped guide channel 46 includes suitable fasteners 54 (shown in FIGS. 1 and 2, for example) for securing the sliding bar 44 with respect to the groove 50 of the guide channel 46 when no lateral shifting movement of the ladder 22 along the guide channel 46 is desired. In the illustrated embodiment, the fasteners 54 comprise set screws 54 although there may be other suitable fasteners for preventing sliding movement of the sliding bar 44 relative to the groove 50. For example, a pin could be inserted through transverse holes in the guide channel 46 for preventing movement of the sliding bar 44 with respect to the guide channel 46.

The set screws 54, or other suitable fasteners, may include eye hooks 58 or handles extending therefrom for facilitating a firm grip for tightening the set screws 54. Preferably, the set screws 54 are tightened until they bear against and engage the sliding bar 44 which, in turn, forces a frictional engagement between the sliding bar 44 and guide channel 46 and, consequently, prevents lateral shifting movement of the ladder 22 relative to the vehicle wall or warehouse shelf. As illustrated in FIGS. 1 and 2, the spacing between two adjacent set screws 54 is preferably less than the length of the sliding bar 44 so that at least one set screw 54 is available for securing the sliding bar 44 during use. Of course, depending on the requirements of a particular application, the spacing may be narrower so that, for example, at least two fasteners 54 are available for securing the sliding bar 44.

The guide channel 46 also defines an elongated slot 62 in substantial alignment with the groove 50 of the guide channel 46 as illustrated in FIG. 3. The slot 62 is adapted to slidably receive therein the pivot arm 34 extending laterally outwardly from the sliding bar 44. In this regard, the pivot arm 34 acts as a guide pin. As the sliding bar 44 is moved slidably through the guide channel 46, the pivot arm 34 (acting as a guide pin) guides the sliding bar 44 along a relatively straight path as the pivot arm 34 travels within the slot 62. As the pivot arm 34 slidably engages the edges of the slot 62, the sliding bar 44 aligns itself within the groove 50 thereby facilitating relatively smoother or freer lateral shifting movement of the sliding bar 44 through the groove 50. For even freer movement, a lubricant, for example, silicone grease or a polytetrafluoroethylene coating, may be applied to the surface of the pivot arm 34 and the coacting edges of the slot 62.

Figure 5:
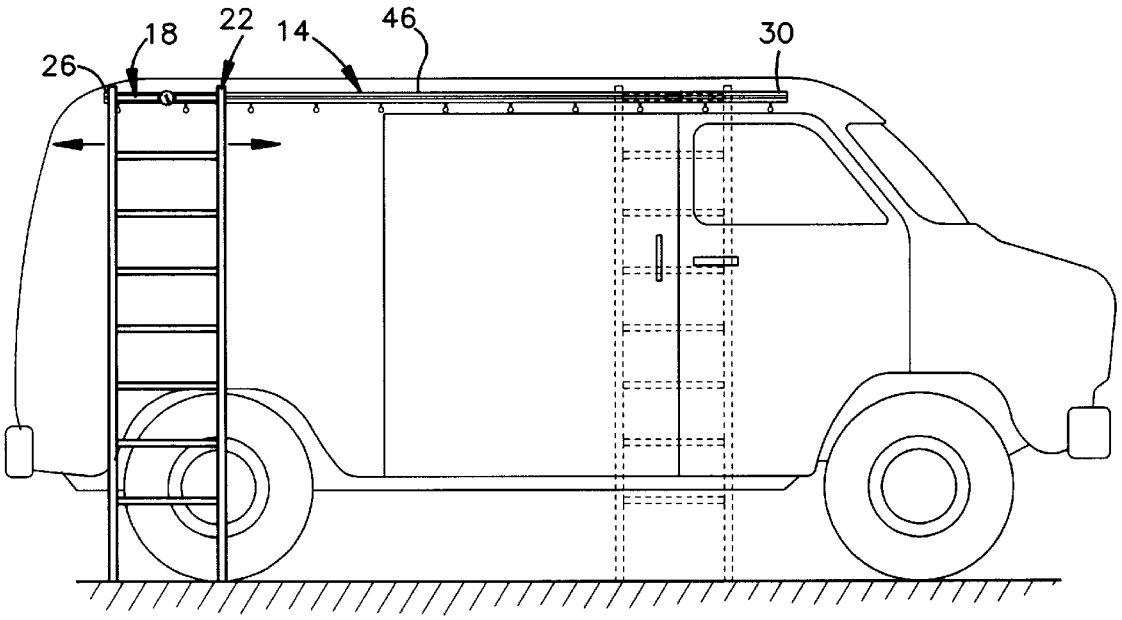
FIG. 5 is a front elevation view of the multi-position ladder of FIG. 1 showing the multi-position ladder on the side of a vehicle in one of multiple generally vertical use positions and, in phantom, in another one of multiple generally vertical use positions.
Figure 7:
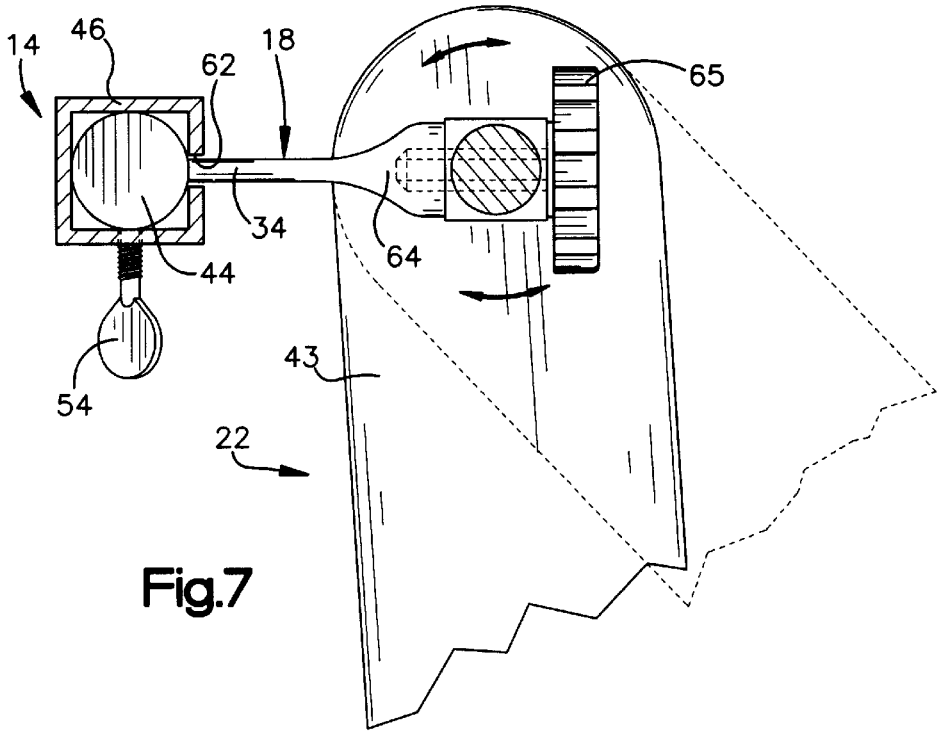
FIG. 7 is a side elevation view of the multi-position ladder of FIG. 1 shown from the plane 7—7 in FIG. 1 and showing the ladder, in phantom, in a position pivoted away from the wall of the vehicle or the frame of a warehouse shelf.

In operation, lateral shifting movement of the ladder 22 translates into sliding movement of the sliding bar 44 within and along the C-shaped guide channel 46. As shown in FIG. 5 and as can be appreciated in view of the foregoing, the ladder 22 may be laterally shifted to any desirable generally vertical use position along the guide channel 46. In this sense, generally vertical is defined to mean a generally upright position. Therefore, the ladder 22 is in a generally vertical configuration while the ladder 22 is laterally shifted across the guide channel 46 although the ladder 22 may be, and of course usually will be, slightly tilted relative to, for example, the side or rear wall of a vehicle or the frame of a warehouse shelf, as shown in FIG. 7 and described below in greater detail.

Once the desired position is attained, the ladder 22 may be secured to the guide channel 46 by tightening the fasteners 54. A worker may then climb the ladder 22 for loading or unloading of materials from, for example, the roof of a vehicle or a warehouse shelf. Should the worker desire closer access to materials further down the roof or shelf, the worker can loosen the fasteners 54 and simply laterally shift the ladder 22 to a more convenient position. Alternatively, the ladder 22 may be laterally shifted to one of the ends 26, 30 of the guide channel 46 and removed therefrom or pivoted to a storage position, as described below in greater detail. The fasteners 54 may then be tightened to secure the ladder 22 in its storage position.

As was alluded to above, the pivot arm 34 also permits the ladder 22 to pivot, that is, swing from side-to-side as is generally represented by the arc-shaped line B—B shown in FIG. 1. As shown in greater detail in FIG. 4, the connecting member 18 further includes the rotating arm 42 which is rotatably mounted at its center onto the pivot arm 34. A bushing 38 or other suitable coupling or bearing member, for example, a roller bearing, is interposed between the pivot arm 34 and rotating arm 42 to ensure relatively stabile rotatable movement of the rotating arm 42 about the pivot arm 34. In the preferred embodiment, the pivot arm 34 includes a boss 64 (FIG. 7) and a polytetrafluoroethylene washer (not shown) against which the rotating arm 42 bears. A polytetrafluoroethylene washer (not shown) and a threaded lug nut 65 retain the rotating arm 42 at the end of the pivot arm 34.

Of course, other suitable pivoting arrangements may be employed to obtain substantially the same result. Thus, for example, in an alternative embodiment, the rotating arm 42 may be fixedly attached to the pivot arm 34 and the pivot arm 34, in turn, pivotably connected to the sliding bar 44. In this regard, the slot 62 may be sized to accommodate such pivotable movement by, for example, providing enlarged, preferably circular, openings spaced along the slot 62 and adapted to receive the width or diameter of the pivot arm 34 as it is pivoted and thereby travels in an arcuate or circumferential path. In another alternative embodiment, the pivot arm 34 itself may be adapted to provide such pivotable movement. The pivot arm 34 may be fixedly attached to both the sliding bar 44 and the rotating arm 42, in which case the sliding bar 44 and rotating arm 42 would take the form of T-shaped brackets and may include an axial coupling providing pivotable movement, or essentially swivelled movement, between the sliding bar 44 and rotating arm 42. In this regard, it will be appreciated that alternative parts and/or arrangements may be used to accomplish the same effect of pivoting movement of the rotating arm 42 along the arc B—B (FIG. 1) and such alternatives are contemplated as falling within the scope of the present invention.

Referring to FIG. 4, the ends 66 of the rotating arm 42 are rounded and are pivotably received in correspondingly sized holes 70 in the upper portion of the ladder uprights 43. A bushing 78 or other suitable bearing member may be disposed within the holes 70 to ensure relatively stabile pivotable movement of the rotating arm's ends 66 within the respective holes 70. In the preferred and illustrated embodiment, the rotating arm 42 takes on the same shape as, and is substantially parallel to, the rungs 80 of the ladder 22 and may even be used as a top rung when the spacing requirements of a particular application permit. Suitable fasteners, for example, such as those described hereinabove, may be used at the pivot and rotate locations to maintain a relatively fixed connection at, and to prevent pivoting or rotating movement of, the rotating arm 42 relative to the pivot arm 34 and the ladder uprights 43.

Figure 6:
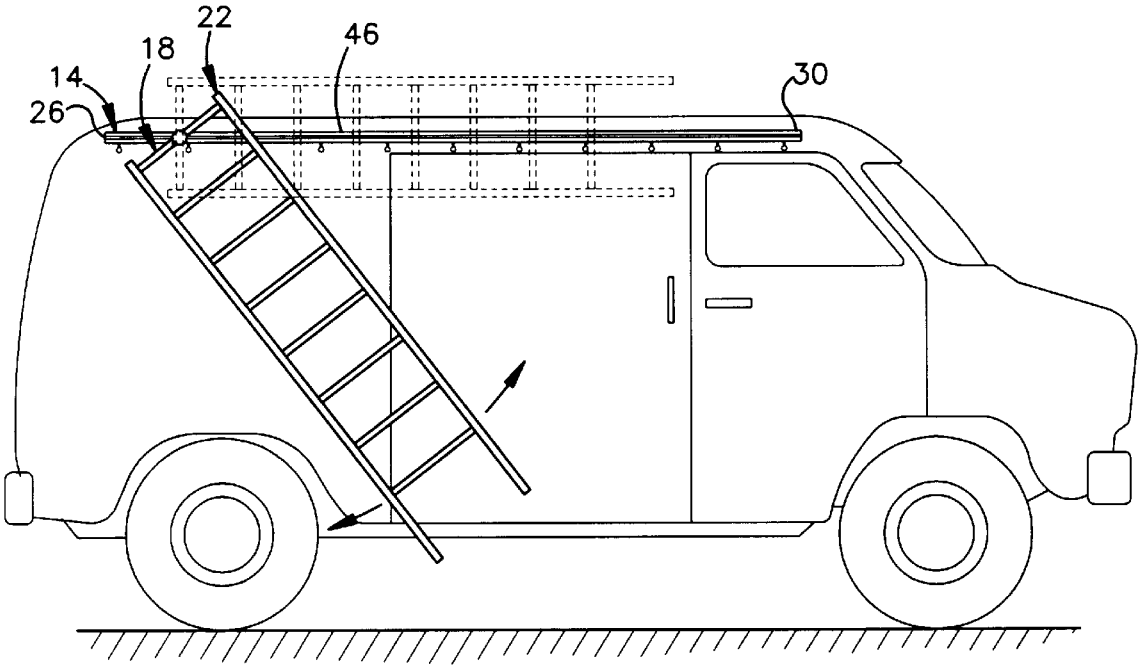
FIG. 6 is a front elevation view of the multi-position ladder of FIG. 1 showing the multi-position ladder on the side of a vehicle in one of multiple storage positions and, in phantom, in another one of multiple storage positions.

In operation, pivoting of the ladder 22 from side-to-side along the arc B—B (FIG. 1) translates into rotating of the rotating arm 42 about the pivot arm 34. As shown in FIG. 6 and as can be appreciated in view of the foregoing, the ladder 22 may be pivotably moved to any desirable storage position and, most preferably, a generally non-vertical storage position. In this sense, generally non-vertical is defined to mean any position other than a generally upright position. The ladder 22 may be pivotably moved from side-to-side although the ladder 22 may be, and of course usually will be, slightly tilted relative to, for example, the side or rear wall of a vehicle or the frame of a warehouse shelf, as shown in FIG. 7 and described below in greater detail. Once a desired storage position is attained, the ladder 22 may be secured to the guide channel 46 at the pivot end of the ladder 22 by tightening one or more of the fasteners 54 and/or to the vehicle side wall or the frame of a warehouse shelf at its free end by other suitable fastening means (not shown).

Referring now to FIG. 7, it is seen that the connecting member 18 also facilitates tilting of the ladder 22 outwardly and/or inwardly with respect to the wall or frame (not shown) to which the guide channel 46 is mounted. The rotating arm 42 permits the ladder uprights 43 to rotate about the rotating arm 42 in a plane (for example, line C—C in FIG. 1) perpendicular to the plane of lateral shifting movement of the ladder 22 (for example, line A—A in FIG. 1). Advantageously, by tilting the ladder 22 in such a manner, the lower ends of the ladder uprights 43 are raised above the ground (or floor) thereby providing a clearance, or gap, that facilitates relatively easier lateral shifting movement of the ladder 22 across the guide channel 46 or pivotable movement of the ladder 22 about the pivot arm 34. Also, the inclination angle of the ladder 22 may be adjusted by placing a block or other suitable support beneath the ladder uprights 43 after raising the ladder 22 by tilting.

Figure 8:
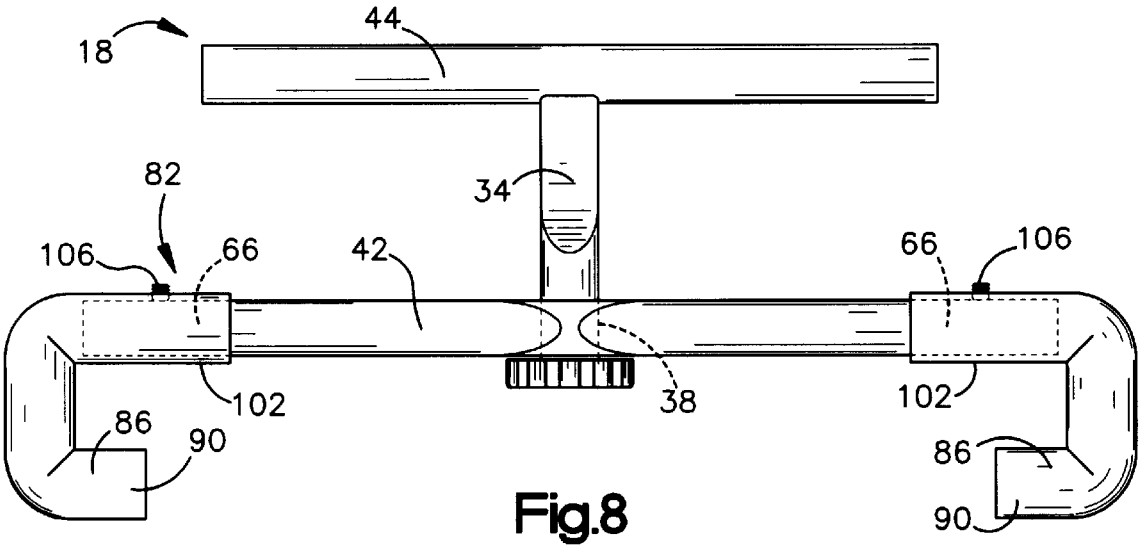
FIG. 8 is an alternative embodiment of a connecting member constructed in accordance with the present invention and, more particularly, a connecting member adapter for connecting an existing ladder to the support member of the present invention.
Figure 9:
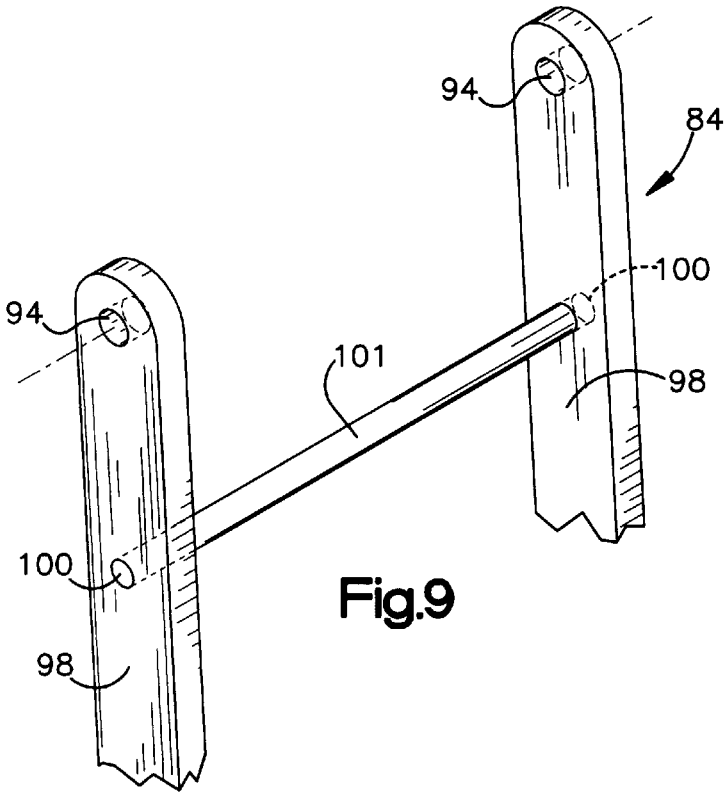
FIG. 9 is a perspective view of an exemplary existing ladder for connection with the connecting member of FIG. 8.

FIG. 8 shows a connecting member adapter 82 that may be used to adapt the connecting member 18 to an existing ladder 84 (FIG. 9). The adapter 82 includes a pair of U-shaped members 86. One leg 90 of each U-shaped member 86 pivotably fits into a correspondingly sized receiving hole 94 in the top of respective ladder uprights 98. Alternatively, the legs 90 may be pivotably mounted into ends 100 of a rung 101. To this end, the rung 101 is fixed relative to the ladder uprights 98 and includes an inside diameter sized to receive the legs 90. The other leg 102 forms a collar, or sleeve, the inside diameter of which corresponds to the outside diameter of an end 66 of the rotating arm 42. The ends 66 of the rotating arms 42 are inserted into the respective collar legs 102 and then secured thereto by fasteners 106, for example, a set screw or the like, for fixedly connecting the U-shaped member 86 to the rotating arm 42. Of course, the U-shaped member 86 may be reversed to accomplish substantially the same result. Thus, the legs 102 may be pivotably connected to the ends 66 of the rotating arm 42 while the other legs 90 are secured into the correspondingly sized receiving holes 94 in ladder uprights 98.

Figure 10:
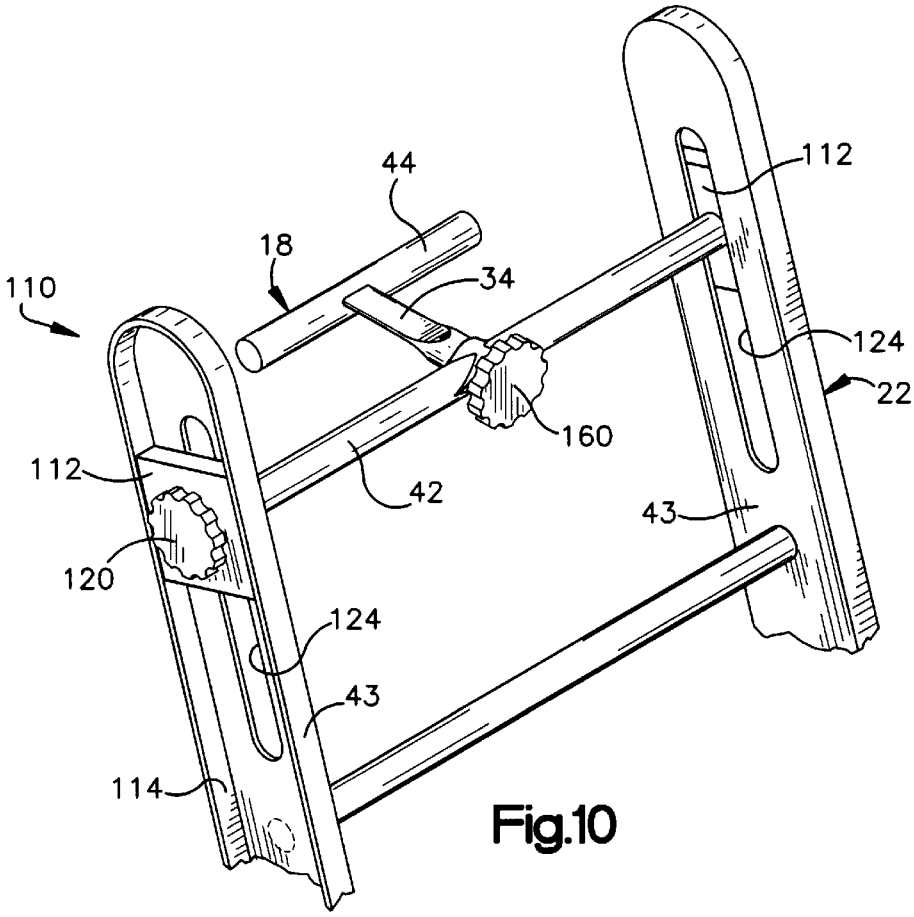
FIG. 10 is a perspective view of a multi-position ladder constructed in accordance with another embodiment of the present invention.

Referring now to FIG. 10, there is shown an adjustment mechanism in accordance with the present invention generally indicated at reference numeral 110. In the several Figures, like reference numerals correspond to like components. The adjustment mechanism 110 permits adjustments of the ladder 22 by sliding the ladder 22 relative to the connecting member 18 along the extent of the ladder 22. When the ladder 22 is in a generally vertical use position, the adjustment mechanism 110 allows the ladder 22 to be selectively adjusted in a generally vertical direction thereby to provide greater clearance below the bottom of the ladder 22 for tilting the ladder 22 outwardly away from the vehicle or warehouse wall or otherwise adjusting the ladder 22 for varying ground surfaces.

The adjustment mechanism 110 includes a pair of inserts 112, preferably made of nylon, that are slidably received within respective guide tracks or channels 114 disposed in the uprights 43 of the ladder 22. The guide tracks 114 cooperatively engage the inserts 112 to provide substantially uniform movement of the ladder 22 relative to the connecting member 18. To facilitate sliding contact between the inserts 112 and the guide tracks 114, the guide tracks 114 may include a polytetrafluoroethylene coating or other lubricant on their interior walls.

The inserts 112 are rotatably connected to respective ends of the rotating arm 42 of the connecting member 18 to enable the ladder 22 to be tilted towards or away from the vehicle wall or warehouse shelf in a manner similar to that described above. Tightening knobs 120 extend through the respective inserts 112 and are threaded to the ends of the rotating arm 42 or, alternatively, are attached with a nut and bolt to the rotating arm 42. When tightened, the tightening knobs 120 maintain the rotating arm 42 fixed with respect to the ladder uprights 43. When loosened, the tightening knobs 120 free the connection between the rotating arm 42 and the ladder uprights 43.

The inserts 112 may additionally and/or alternatively be in the form of rotatable disks or wheels (not shown) to provide rolling contact in the guide tracks or channels 114. Also, while the nylon inserts 112 are shown in FIG. 10 to be disposed on the outside of the ladder uprights 43, they could alternatively be disposed on the inside of the ladder uprights 43. Of course, the tightening knobs 120 would likewise be located on the inside of the ladder uprights 43. Further still, the adjustment mechanism 100 may not include inserts 112, in which case the tightening knobs 120 provide sufficient locking force to secure the rotating arm 42 with respect to the ladder 22.

The uprights 43 of the ladder 22 include elongated slots 124 that extend along a portion of the length of the ladder 22. In the illustrated exemplary embodiment, the slots 124 extend from near the top portion of the ladder 22 to near the second rung of the ladder 22. The slots 124 slidably receive therethrough the respective ends of the rotating arm 42 of the connecting member 18. The sliding engagement between the ladder uprights 43 and the ends of the rotating arm 42 via the respective slots 124 provides guided movement of the ladder 22 along its length dimension or, as shown in the illustrated embodiment, in an upward or downward generally vertical direction. Like the guide tracks 114, the slots 124 may include a lubricant to facilitate sliding contact between the ladder uprights 43 and the ends of the rotating arm 42.

Figure 11A:
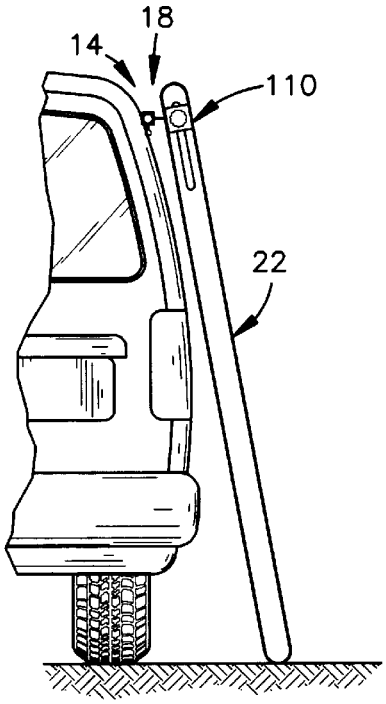
FIG. 11A is a side elevation view of the multi-position ladder of FIG. 10 showing the ladder resting on a surface having the same elevation as a vehicle to which the ladder is connected.
Figure 11B:
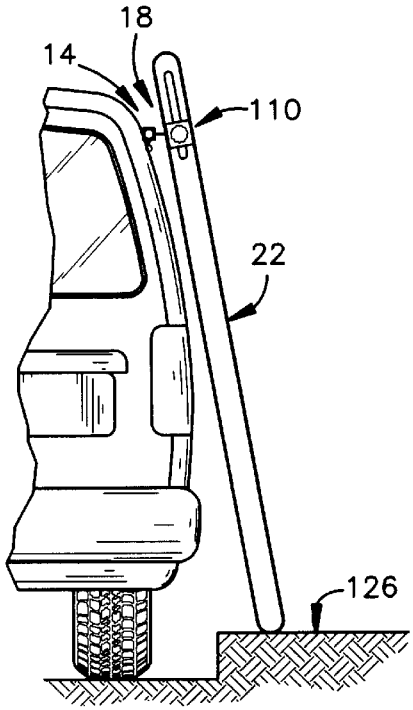
FIG. 11B is a side elevation view of the multi-position ladder of FIG. 10 showing the ladder resting on a surface having a different elevation than a vehicle to which the ladder is connected.
Figure 12A:
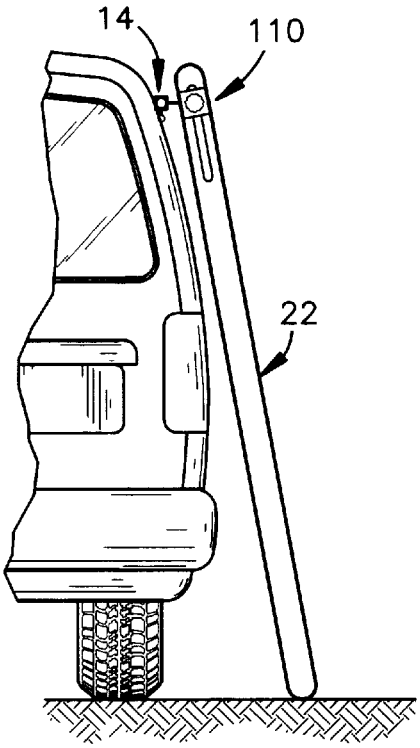
FIGS. 12A–12D are sequential side elevation views of the ladder of FIG. 10 showing the ladder being positioned to a different tilt angle.
Figure 12B:
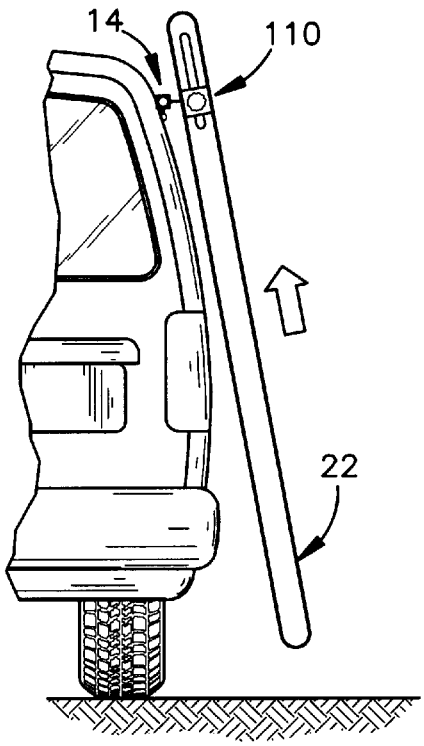
Figure 12C:
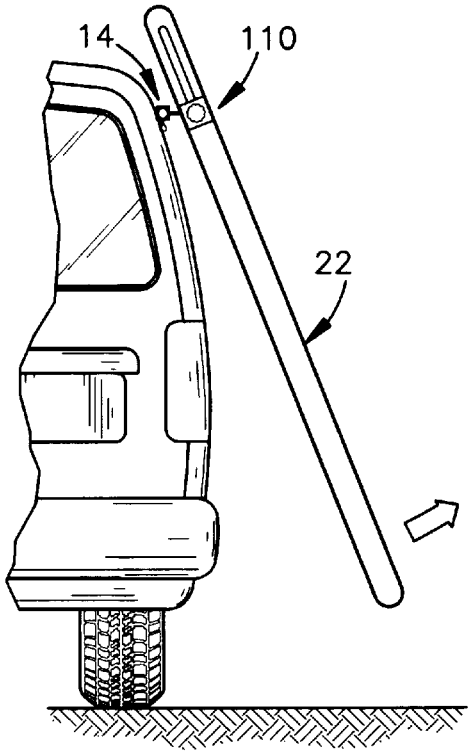
Figure 12D:
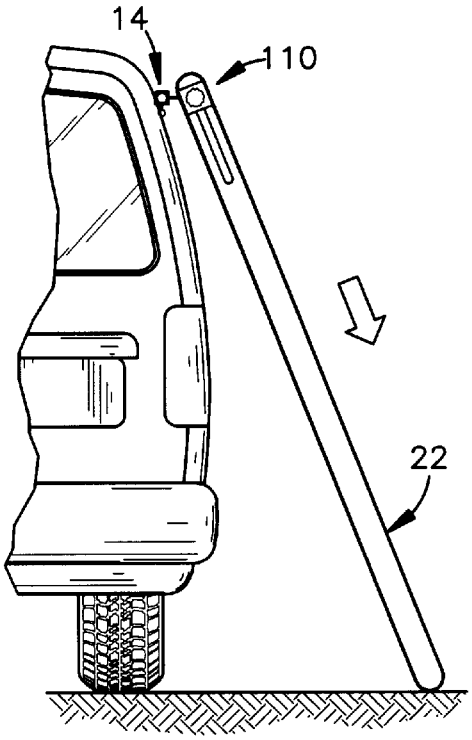

As alluded to above, the adjustment mechanism 110 allows the ladder 22 to be adjusted to compensate for differences in the spacing between the longitudinally extending support member 14 and the ground, floor or other surface on which the ladder 22 may rest. Thus, in one instance the bottom of the ladder 22 may be at the same elevation as, for example, the vehicle shown in FIG. 11A. In another instance, as shown in FIG. 11B, the bottom of the ladder 22 may require resting on a surface such as a curb 126 that is slightly higher in elevation than the surface on which the vehicle rests, in which case the ladder 22 may be adjusted upwardly to compensate for the difference in elevation.

The adjustment mechanism 110 also enables the slope or tilt of the ladder 22 to be adjusted to different angles relative to the ground. Referring to FIGS. 12A–12D, for example, it may be desirable to have the ladder 22 sloped at a smaller angle than that shown in FIG. 12A to make the climbing thereof easier. To change the slope of the ladder 22, a user may simply loosen the tightening knobs 120, slide the ladder 22 vertically upwardly (FIG. 12B), tilt the ladder 22 outwardly away from the side of the vehicle wall (FIG. 12C), slide the ladder 22 vertically downwardly (FIG. 12D), and then tighten the tightening knobs 120 to thereby secure the ladder 22 in its new position.

Figure 13:
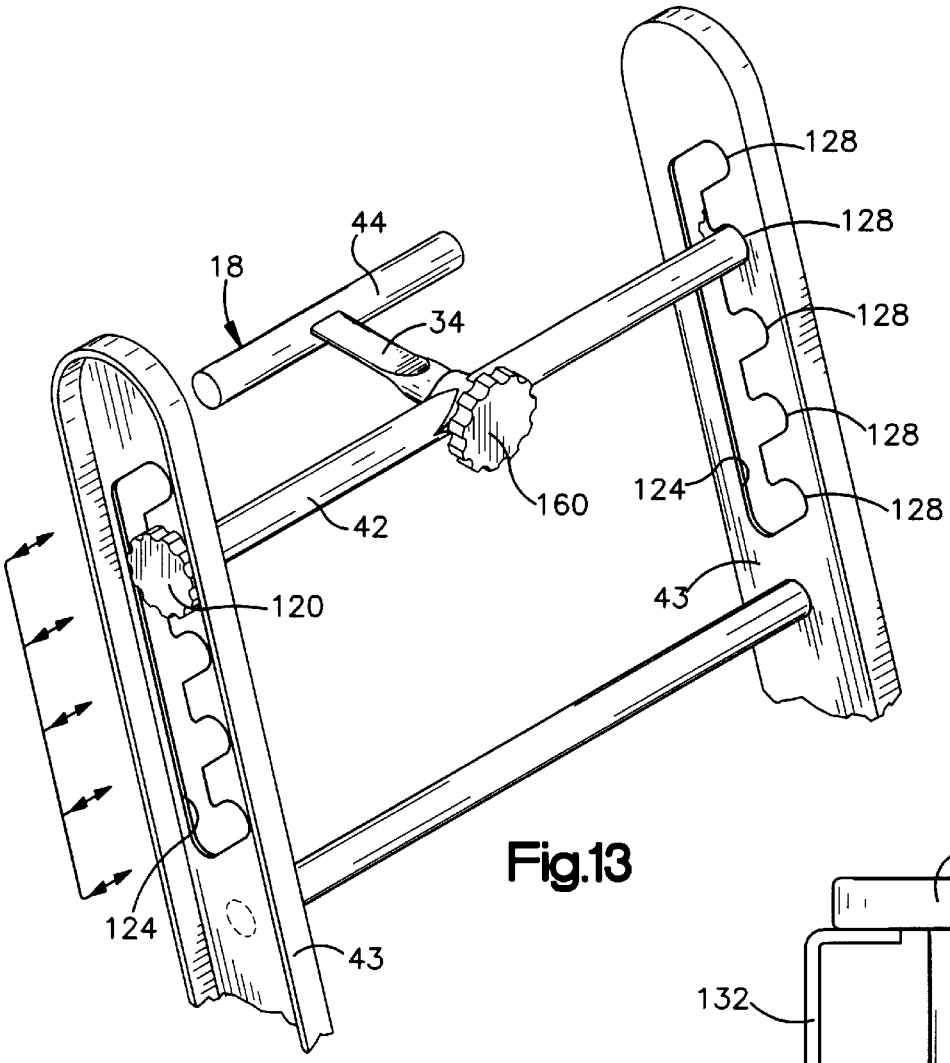
FIG. 13 is a perspective view of a multi-position ladder constructed in accordance with another embodiment of the present invention.

As can be appreciated by the foregoing, the path of travel of the ladder 22 is a function of the dimensions of the slots 124. To this end, as shown in FIG. 13, the slots 124 may additionally include segments 128 for enabling the ladder 22 to be vertically adjusted in increments to decrease or increase the spacing between the bottom of the ladder 22 and the ground. The segmented slots 128 may also facilitate tilting the ladder 22 to different angles relative to the ground, in which case each segment would represent a different tilt angle.

Figure 14:
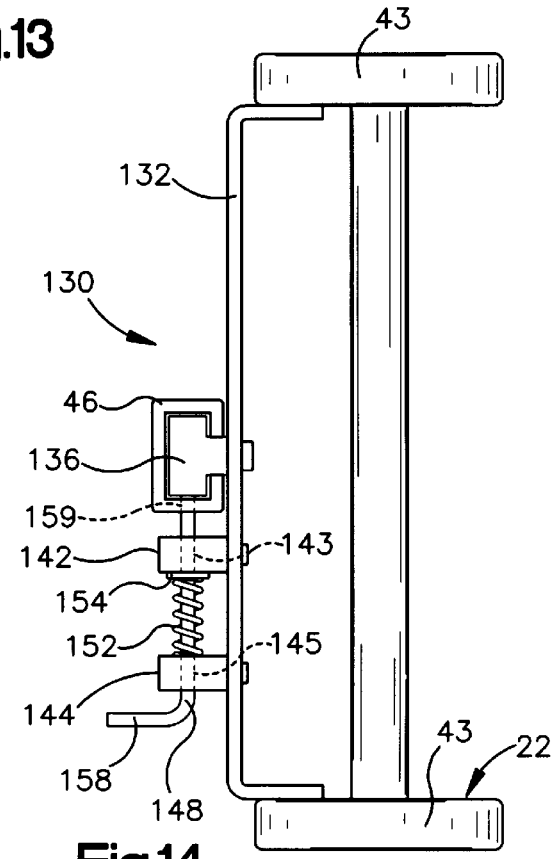
FIG. 14 is a bottom plan view of a ladder constructed in accordance with another embodiment of the present invention and showing locking assembly for selectively locking the ladder in a storage position.

Referring now to FIG. 14, there is shown a locking assembly in accordance with the present invention generally indicated at reference numeral 130. The locking assembly 130 provides selective securing of the ladder 22 in a storage position by providing selective engagement of the bottom of the ladder 22 with the longitudinally extending support member 14 (see FIG. 1).

The locking assembly 130 comprises a spacer bar 132 transversely attached to the ladder uprights 43 of the ladder 22 and an insert 136, preferably made of nylon, in sliding engagement with the guide channel 46 of the longitudinally extending support member 14. The spacer bar 132 and insert 136 are adapted to slidably connect a portion of the ladder 22 (preferably the bottom portion) to the guide channel 46 so that the spacing of the ladder 22 from the vehicle wall or warehouse shelf is substantially uniform. As shown in FIG. 14, the insert 136 is generally T-shaped to conform with the groove 50 of the C-shaped guide channel 46. This secures the ladder 22 from outward movement (to the right in FIG. 14) from the support member 14 when the ladder 22 is in a storage position.

The locking assembly 130 includes upper and lower mounts 142, 144 that are connected to the spacer bar 132 and are vertically aligned with respect to the insert 136. The mounts 142, 144 have holes 143, 145 extending therethrough for slidably receiving therein a locking pin 148. The locking pin 148 is biased upwardly by a spring 152 disposed between the lower mount 144 and a washer 154 that is connected to the pin 148 and abuts the upper mount 142 when the locking assembly 130 is in its engaged position.

To lock the ladder 22 in a storage position, the pin 148 is retracted as by pulling a handle 158 connected to the pin 148 to overcome the biasing force of the spring 152 and then the insert 136 is inserted into the guide channel 46 of the longitudinally extending support member 14. After the insert 136 is inserted, the pin 148 may be released, in which case the pin 148 will slidably bear against the guide channel 46. The ladder 22 is moved laterally along the guide channel 46 until the end of the pin 148 aligns with a locator hole 159 in the guide channel 46. In the aligned position, the pin 148 automatically engages the hole 159 and preferably extends far enough into the hole 159 to engage the insert 136 inside the channel 46. This provides a firm connection between the insert 136 and the support member 14. Of course, the insert 136 may include a hole (not shown) aligned with the holes 143, 145 of the mounts 142, 144 for receipt therein of the end of the pin 148 to provide even greater stiffness in the connection. It will be appreciated that when the locking assembly 130 is in its engaged position the pin 148 locks the ladder 22 to a storage position by preventing lateral movement of the ladder 22 relative to the support member 14.

To disengage the pin 148 from the hole 159 a user temporarily pulls the locking pin 148 to overcome the bias in the spring 152 and then retracts the ladder 22 a sufficient amount so that the pin 148 is no longer in alignment with the hole 154. The user can then laterally slide the ladder 22 out of the guide channel 46.

It is noted that additional holes may be provided in the guide channel 46 to permit the ladder 22 to be stored in one of numerous storage positions along the elongated support member 14.

In an alternative embodiment (not shown), the guide channel 46 may include a ratcheting device and the ladder 22 may include a coacting lever that is automatically engaged by the ratcheting device (e.g., by spring biasing means) as the ladder 22 is slidably inserted into the elongated support member 14 to thereby secure the ladder relative to the guide channel 46. To withdraw the ladder 22 from its storage position, the lever may then be depressed to thereby disengage the ratcheting device and allow the ladder 22 to be withdrawn from the guide channel 46.

Referring again to FIGS. 1, 10 and 13, a tightening knob 160 is preferably attached at the end of the pivot arm 34 for selectively securing the rotating arm 42 to the pivot arm 34. By tightening the tightening knob 160, the pivot arm 34 is secured to the rotating arm 42 which, in turn, allows one to maintain the sliding bar 44 parallel with respect to the rotating arm 42. Thus, when the ladder 22, and more particularly the insert 136, is withdrawn from the guide track 46, the sliding bar 44 will not inadvertently swivel at the bushing 38. This simplifies insertion of the sliding bar 44 into the guide channel 46 of the support member 14. Moreover, by tightening the tightening knobs 120 associated with the adjusting mechanism 110, the connecting member 18 remains steady with respect to the ladder 22. Thus, the entire ladder 22, along with the connecting member 18, may be laterally removed from the guide channel 46 as an integral component without regard to inadvertent rotating or pivoting of interacting components. This is particular useful in situations where the user desires to move the ladder 22 from one guide track to another, for example, from a guide track on one side of a vehicle to a guide track on the other side of the vehicle.

Moreover, the adjustment mechanism 110 and tightening knob 160 enable the ladder to be stored in a vertical position as by sliding the ladder 22 vertically upwardly until the bottom of the ladder 22 is a sufficient height from the ground (or, for example, until the rotating arm 42 reaches the bottom of the slots 124) and then tightening the tightening knobs 120 and 160. It will be appreciated that since the ladder 22 may also be pivoted about the pivot arm 34 and then thereafter locked by the tightening knob 160, that the ladder 22 may be stored in any of multiple storage positions between a vertical position and, as described above, a horizontal position.

In view of the foregoing, it will be appreciated that the support member 14 and connecting member 18 of the present invention facilitate three types of movement of the ladder 22, namely lateral shifting movement along the C-shaped guide channel 46, pivotable movement about the pivot arm 34 from side-to-side, and tilting movement about the rotating arm 42 away from and towards the wall or frame to which the guide channel 46 is connected. The movements may be made either simultaneously or independently depending on, of course, the limitations or needs of a particular loading/unloading site. Also, in the case of a vehicle, additional support members 14 may be mounted to the rear and/or other side of the vehicle to facilitate substantially 270 degree access to the roof of the vehicle. Similarly, additional support members 14 may be mounted to multiple frame members 14 of a warehouse shelf or shelves. In this regard, the support members 14 may be mounted at different levels of shelves so that, for example, adjacent levels may have their ladders 22 selectively aligned for climbing the ladders 22 in sequence and gaining access to the two adjacent levels. After loading and/or unloading is completed, the ladders 22 can then be selectively pivoted to an out-of-the-way storage position. In either case, the multi-position ladder 10 may be conveniently moved to an out-of-the-way yet accessible position, conveniently positioned for access to a loading/unloading site, and readily and conveniently returned to its storage position.

It is noted that the various components, assemblies, devices and compositions of the present invention may be made with any type and/or number of suitable materials. The materials referred to in the description of the invention, as well as the claims appended hereto, are preferred materials. It will be appreciated that the present invention is not limited to any specific material usage.

Although the invention has been shown and described with respect to a certain preferred embodiment or embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A multi-position ladder, comprising:

a ladder;

a support member for supporting said ladder, the support member being operable to mount to a wall, vehicle or other surface; and a connecting member connecting said support member and said ladder;

said connected member supported said ladder for sliding movement of said ladder relative to the connecting member along at least a portion of the length of the ladder, wherein said ladder includes uprights having elongated grooves disposed along at least a portion of the length of the ladder for slidably receiving therein said connecting member for guiding the ladder during sliding movement thereof, and wherein the connecting member includes an adjustment mechanism including respective inserts that are slidably received within the elongated grooves, and wherein the inserts cooperatively engage the elongated grooves of the ladder uprights to provide substantially uniform movement of the ladder relative to the connecting member.

2. The multi-position ladder of claim 1, wherein the connecting member supports said ladder for tilting movement of said ladder towards and away from the wall, vehicle or other surface.

3. The multi-position ladder of claim 2, wherein the tilting movement defines a plane substantially perpendicular to a plane defined by said lateral shifting movement.

4. The multi-position ladder of claim 1, wherein the inserts are made of nylon.

5. The multi-position ladder of claim 1, wherein the elongated grooves are lubricated to facilitate sliding contact between the inserts and the grooves.

6. The multi-position ladder of claim 1, wherein the adjustment mechanism further includes at least one tightening knob that, when tightened, substantially inhibits tilting movement and sliding movement of the ladder relative to the support member and, when loosened, permits said tilting and sliding movements.

7. The multi-position ladder of claim 1, wherein said connecting member includes a rotating arm extending transverse to the length of the ladder, the ends of the rotating arm being in sliding engagement with said one or more elongated grooves during sliding movement of the ladder.

8. The multi-position ladder of claim 7, wherein the elongated grooves include segments for providing incremental sliding movement of the ladder.

9. The multi-position ladder of claim 1, wherein said support member is longitudinally extending and said connecting member is adapted to permit lateral shifting movement along said support member to thereby permit lateral positioning of the ladder to one of multiple generally vertical use positions along the extent of said support member.

10. The multi-position ladder of claim 9, wherein, when the ladder is in a generally vertical use position, the connecting member allows the ladder to be selectively adjusted in a generally vertical direction.

11. The multi-position ladder of claim 9, wherein said connecting member includes a rotating arm extending transverse to the length of the ladder, the ends of the rotating arm being in sliding engagement with said one or more elongated grooves during sliding movement of the ladder.

12. The multi-position ladder of claim 11, wherein the elongated grooves include segments for providing incremental sliding movement of the ladder in a generally vertical direction.

13. The multi-position ladder of claim 1, wherein the connecting member supports said ladder for pivotal movement about a point where the ladder couples to the support member via the connecting member in an arc from side-to-side between a generally vertical use position and a storage position.

14. A multi-position ladder, comprising:

a ladder;

a support member for supporting said ladder, the support member being operable to mount to a wall, vehicle or other surface; and a connecting member connecting said support member and said ladder;

said connected member supported said ladder for sliding movement of said ladder relative to the connecting member along at least a portion of the length of the ladder, wherein said ladder includes an upright having one or more elongated slots disposed therein along at least a portion of the length of the ladder and said connecting member includes a rotating arm extending transverse to the length of the ladder, the ends of the rotating arm being in sliding engagement with said one or more slots during sliding movement of the ladder, and wherein said rotating arm is pivotably mounted at its ends within the slots for permitting tilting movement of said ladder.

15. The multi-position ladder of claim 14, wherein at least one end of said rotating arm includes a tightening knob for selectively securing said end to the ladder thereby to substantially inhibit tilting movement and sliding movement of the ladder relative to the rotating arm.

16. A multi-position ladder, comprising:

a ladder;

a support member for supporting said ladder, the support member being operable to mount to a wall, vehicle or other surface;

a connecting member connecting said support member and said ladder;

said connecting member supporting said ladder for pivotal movement about a point where the ladder couples to the support member via the connecting member in an arc from side-to-side between a generally vertical use position and a storage position and for sliding movement of said ladder relative to the connecting member along at least a portion of the length of the ladder; and a locking assembly for selectively securing a free end of the ladder to the support member when the ladder is pivoted to a storage position, wherein the support member includes a locator hole and the locking assembly includes a locking pin that is biased to slidably engage the support member though the locator hole to prevent lateral movement of the ladder along the support member.

17. A multi-position ladder, comprising:

a ladder;

a support member for supporting said ladder, the support member being operable to mount to a wall, vehicle or other surface;

a connecting member connecting said support member and said ladder;

said connecting member supporting said ladder for pivotal movement about a point where the ladder couples to the support member via the connecting member in an arc from side-to-side between a generally vertical use position and a storage position and for sliding movement of said ladder relative to the connecting member along at least a portion of the length of the ladder; and a locking assembly for selectively securing a free end of the ladder to the support member when the ladder is pivoted to a storage position, wherein the locking assembly further includes a locking mechanism connected to the ladder, the locking mechanism being selectively moveable between an engaged position to prevent lateral movement of the ladder along the support member and a disengaged position to permit said lateral movement, and wherein the locking mechanism includes at least one mount spaced apart from and aligned with the engaging member, the mount including a hole therethrough for receipt therein of a locking pin so that when the locking pin engages the support member through a locator hole associated with the support member, the locking pin engages the support member.

18. A multi-position ladder, comprising:

a ladder including a pair of uprights having respective guide tracks and elongated slots disposed therein along the length of the ladder;

a longitudinally extending support member for supporting the ladder, the support member being operable to mount to a wall, vehicle or other surface; and a connecting member connecting the support member and the ladder;

said connecting member including respective inserts that are slidably received within the guide tracks, the inserts cooperatively engaging the elongated slots of the ladder uprights to provide substantially uniform movement of the ladder relative to the connecting member, and a rotating arm extending transverse to the length of the ladder, the ends of the rotating arm being slidably received in the elongated slots for permitting tilting movement of the ladder, and sliding movement of the ladder along the ends of the rotating arm in a generally vertical direction.

* * * * *

UNITED STATES PATENT AND TRADEMARK OFFICE

CERTIFICATE OF CORRECTION

PATENT NO.: 6,105,720

DATED: August 22, 2000

INVENTOR(S): Don A. Kumher
Boyd S. Kumher

It is certified that error appears in the above-identified patent and that said Letters Patent is hereby corrected as shown below:

Title page, Inventors: Don A. Kumher, 13770 Fisher Rd., Burton, Ohio 44021; Boyd S. Kumher, 18057 Claridon-Troy Rd., Hiram, Ohio 44234

Column 12, line 21: Please replace the word "particular" with --particularly--.

Column 15, line 13: Please replace the word "though" with --through--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*